US010890359B2

(12) United States Patent
Kitano et al.

(10) Patent No.: US 10,890,359 B2
(45) Date of Patent: Jan. 12, 2021

(54) HEATING AND HOT WATER SUPPLY DEVICE

(71) Applicant: NORITZ CORPORATION, Hyogo (JP)

(72) Inventors: Yoshihisa Kitano, Hyogo (JP); Yasutaka Kuriyama, Hyogo (JP); Yasushi Morita, Hyogo (JP); Hiroshi Morimoto, Hyogo (JP); Midori Yokoyama, Hyogo (JP)

(73) Assignee: NORITZ CORPORATION, Hyogo (JP)

( * ) Notice: Subject to any disclaimer, the term of this patent is extended or adjusted under 35 U.S.C. 154(b) by 128 days.

(21) Appl. No.: 16/318,369

(22) PCT Filed: May 24, 2017

(86) PCT No.: PCT/JP2017/019342
§ 371 (c)(1),
(2) Date: Jan. 17, 2019

(87) PCT Pub. No.: WO2018/020806
PCT Pub. Date: Feb. 1, 2018

(65) Prior Publication Data

US 2019/0154303 A1 May 23, 2019

(30) Foreign Application Priority Data

Jul. 26, 2016 (JP) ..... 2016-146596

(51) Int. Cl.
*F24D 3/02* (2006.01)
*F24H 9/20* (2006.01)
(Continued)

(52) U.S. Cl.
CPC ..... *F24H 9/2035* (2013.01); *F24D 3/08* (2013.01); *F24D 19/1015* (2013.01);
(Continued)

(58) Field of Classification Search
CPC ... F24C 13/00; F24D 3/02; F24D 3/04; F22D 7/00; F24H 9/1809
See application file for complete search history.

(56) References Cited

U.S. PATENT DOCUMENTS 4,522,253 A * 6/1985 Levin ..... F24D 11/0214 165/207
7,058,457 B2 * 6/2006 Kuwahara ..... G05B 15/02 700/11
(Continued)

FOREIGN PATENT DOCUMENTS

JP H0221126 1/1990
JP H05288402 11/1993
(Continued)

OTHER PUBLICATIONS

"International Search Report (Form PCT/ISA/210) of PCT/JP2017/019342," dated Aug. 1, 2017, with English translation thereof, pp. 1-4.

*Primary Examiner* — Gregory A Wilson
(74) *Attorney, Agent, or Firm* — JCIPRNET

(57) ABSTRACT

In a heating and hot water supply device including a burning means, a first heat exchanger, a circulation passage for circulating a heating thermal medium, a circulation pump, a first bypass passage, a second heat exchanger for hot water supply, a hot water supply passage, a second bypass passage bypassing the second heat exchanger, a control unit, and an operating terminal, a distribution means is provided at a branching portion of the first bypass passage and is capable of adjusting its distribution ratio for heating, or hot water supply, or simultaneous heating/hot water supply, a display means of the operating terminal is capable of providing displays corresponding to various types of operation.

2 Claims, 2 Drawing Sheets

(51) Int. Cl.
*F24D 3/08* (2006.01)
*F24D 19/10* (2006.01)
*F24H 1/52* (2006.01)

(52) U.S. Cl.
CPC ..... *F24D 19/1069* (2013.01); *F24H 1/52* (2013.01); *F24D 2220/0271* (2013.01); *F24D 2220/042* (2013.01)

(56) References Cited

U.S. PATENT DOCUMENTS 9,010,281 B2 * 4/2015 Fushiki ..... F24H 4/04 122/448.1
9,021,993 B2 * 5/2015 Furukawa ..... F28F 19/00 122/14.3
9,250,105 B2 * 2/2016 Patel ..... G01F 15/0755
9,886,043 B2 * 2/2018 Yuge ..... G05D 23/1919
10,330,328 B2 * 6/2019 Land, III ..... F24D 19/10
10,337,763 B2 * 7/2019 Okamoto ..... F24H 9/2042
2010/0117843 A1 * 5/2010 Kobayashi ..... F24D 17/02 340/622
2015/0034190 A1 * 2/2015 Jebran ..... E03B 7/04 137/565.11
2015/0034730 A1 * 2/2015 Minamisako ..... F24D 19/1024 237/2 B
2016/0033171 A1 * 2/2016 Mase ..... F24H 1/145 122/14.3
2016/0047558 A1 * 2/2016 Shimada ..... F24D 19/1069 237/8 A
2017/0363301 A1 * 12/2017 Son ..... F24D 17/0005

FOREIGN PATENT DOCUMENTS

JP H0823436 3/1996
JP H10122579 5/1998
JP 2002188820 7/2002
JP 2003294315 10/2003
JP 2005337632 12/2005
JP 2009198045 9/2009

* cited by examiner

HEATING AND HOT WATER SUPPLY DEVICE

CROSS-REFERENCE TO RELATED APPLICATION

This application is a 371 application of the International PCT application serial no. PCT/JP2017/019342, filed on May 24, 2017, which claims priority benefits of Japan Patent Application No. 2016-146596 filed on Jul. 26, 2016. The entirety of each of the abovementioned patent applications is hereby incorporated by reference herein and made a part of this specification.

TECHNICAL FIELD

The present invention relates to a heating and hot water supply device that performs heating (i.e. room heating etc.) by applying heat produced by combustion to a heating thermal medium, and that also performs supply of hot water by applying heat to fresh water by heat exchange with the heating thermal medium, and in particular relates to a heating and hot water supply device that is capable of performing heating operation and hot water supply operation simultaneously.

BACKGROUND ART

Heating and hot water supply devices that are capable of performing changeover between heating operation and hot water supply operation are widely employed. A heating and hot water supply device of this type comprises a combustion means, a main heat exchanger, and a heating apparatus, and also comprises a circulation passage for circulating a heating thermal medium between the main heat exchanger and the heating apparatus with a circulation pump, and a bypass passage that branches off from the circulation passage and bypasses the heating apparatus. A heat exchanger for hot water supply is provided in the bypass passage, and the heat exchanger is arranged so as to be capable of heating the hot water flowing in the hot water supply passage in the heat exchanger for hot water supply by using the heating thermal medium. A changeover means is provided at the portion where the circulation passage and the bypass passage branch apart, so that the destination for the heating thermal medium can be changed over between the heating apparatus and the heat exchanger for hot water supply.

During heating operation, in the main heat exchanger, heat is applied to the heating thermal medium by the combustion gases produced by the combustion means, and the changeover means is changed over so that the heating thermal medium is circulated in the circulation passage. The heating thermal medium to which heat has been applied dissipates heat to the heating apparatus, and then returns to the main heat exchanger.

During hot water supply operation, the changeover means is changed over so that the heating thermal medium to which heat has been applied is circulated in the bypass passage. And heat is applied to water flowing in the hot water supply passage by the heating thermal medium in the heat exchanger for hot water supply that is provided in the bypass passage, so that hot water is supplied. The heating thermal medium that has thus exchanged heat in the heat exchanger for hot water supply then returns to the main heat exchanger.

A heating and hot water supply device that performs this sort of changeover between heating operation and hot water supply operation is provided with an operating terminal for performing operations of various types. A display means is provided to the operating terminal, and is capable of displaying settings related to the heating and hot water supply device and its operating status. For example, during heating operation, the display means can provide a display of the set temperature for heating and a display indicating heating operation, and during hot water supply operation the display means can provide a display of the set temperature for hot water supply and a display indicating hot water supply operation.

Moreover, there is a type of device with which a display corresponding to operation to fill hot water into a bathtub, and a display corresponding to another type of hot water supply operation, are provided separately, and with which these displays can be changed over, such as, for example, the hot water supply device disclosed in Patent Document #1, although this is not a heating and hot water supply device.

PRIOR ART DOCUMENT

Patent Document

Patent Document #1; Japanese Pat. Publication H8-23436.

SUMMARY OF INVENTION

Technical Problem

However, in a heating and hot water supply device that, in addition to being capable of performing heating operation or hot water supply operation, is also capable of performing simultaneous heating operation and hot water supply operation, a display corresponding to simultaneous space heating operation and hot water supply operation is required for checking the operating status; but the display means of prior art of heating and hot water supply devices have not been adapted to be capable of providing any display corresponding to simultaneous heating operation and hot water supply operation. On the other hand, if displays corresponding to each type of operation are provided independently, as in the case of the display means of Patent Document #1, then there is the problem that the display becomes complicated and it becomes difficult to check the operating status visually. Moreover, increasing the number of displays to correspond to simultaneous heating operation and hot water supply operation is not desirable, because the manufacturing cost of the operating terminal increases.

The object of the present invention is to provide a heating and hot water supply device that is capable of performing either heating operation, or hot water supply operation, or simultaneous heating operation and hot water supply operation, and whose operating status can be easily checked visually with displays corresponding to these various types of operation.

Means to Solve the Problem

The present invention presents a heating and hot water supply device comprising a combustion means, a main heat exchanger, a circulation passage connected to the main heat exchanger and a heating apparatus, a circulation pump provided in the circulation passage, a bypass passage that branches off from the circulation passage and bypasses the heating apparatus, a heat exchanger for hot water supply provided in the bypass passage, a hot water supply passage for supplying cold water to the heat exchanger for hot water supply and for supplying hot water heated to a predetermined set hot water supply temperature by the heat exchanger for hot water supply, a control unit that controls the plurality of devices, and an operating terminal connected to the control unit so as to be capable of communication therewith for performing various operations, wherein: a distribution means is provided at a branching portion of the bypass passage, and the distribution means is capable of adjusting its distribution ratio so that heating operation, or hot water supply operation, or simultaneous heating operation and hot water supply operation become possible, and a display means is provided to the operating terminal, and is capable of providing displays corresponding to above described various types of operation.

According to the constitution described above, the heating and hot water supply device is capable of the three types of operation such as heating operation, hot water supply operation and simultaneous heating operation and hot water supply operation; and it is possible visually to check the operating status simply and easily by employing the displays which correspond to the various types of operation.

The display means may be adapted to provide at least a heating display corresponding to heating operation and a hot water supply display corresponding to hot water supply operation, and, during simultaneous heating operation and hot water supply operation, the heating display and the hot water supply display may be illuminated, may be flashed simultaneously, or may be flashed alternately.

According to the constitution described above, since it is possible to display the three operating statuses for heating operation, hot water supply operation, and simultaneous heating operation and hot water supply operation by employing the two displays, i.e. the heating display and hot water supply display, accordingly it is possible visually to check the operating status of the heating and hot water supply device easily by employing these simple displays.

If the present operational output is insufficient with respect to the required operating capability for the corresponding operation, then at least one of a heating display corresponding to the heating operation and a hot water supply display corresponding to the hot water supply operation may be displayed in a display mode that is different from when there is no such shortage of operational output.

According to the constitution described above, it is possible visually to check the operating status of the heating and hot water supply device simply and easily when at least one of the heating operation and the hot water supply operation is operating at an output that is lower than the necessary operating capacity required for appropriate operation.

Advantages of Invention

According to the present invention, it is possible to provide a heating and hot water supply device that is capable of performing either heating operation, or hot water supply operation, or simultaneous heating operation and hot water supply operation, and whose operating status can be easily checked visually with appropriate displays corresponding to these various types of operation.

DESCRIPTION OF EMBODIMENTS

In the following, implementations of the present invention will be explained on the basis of an embodiment.

The Embodiment

Figure 1:
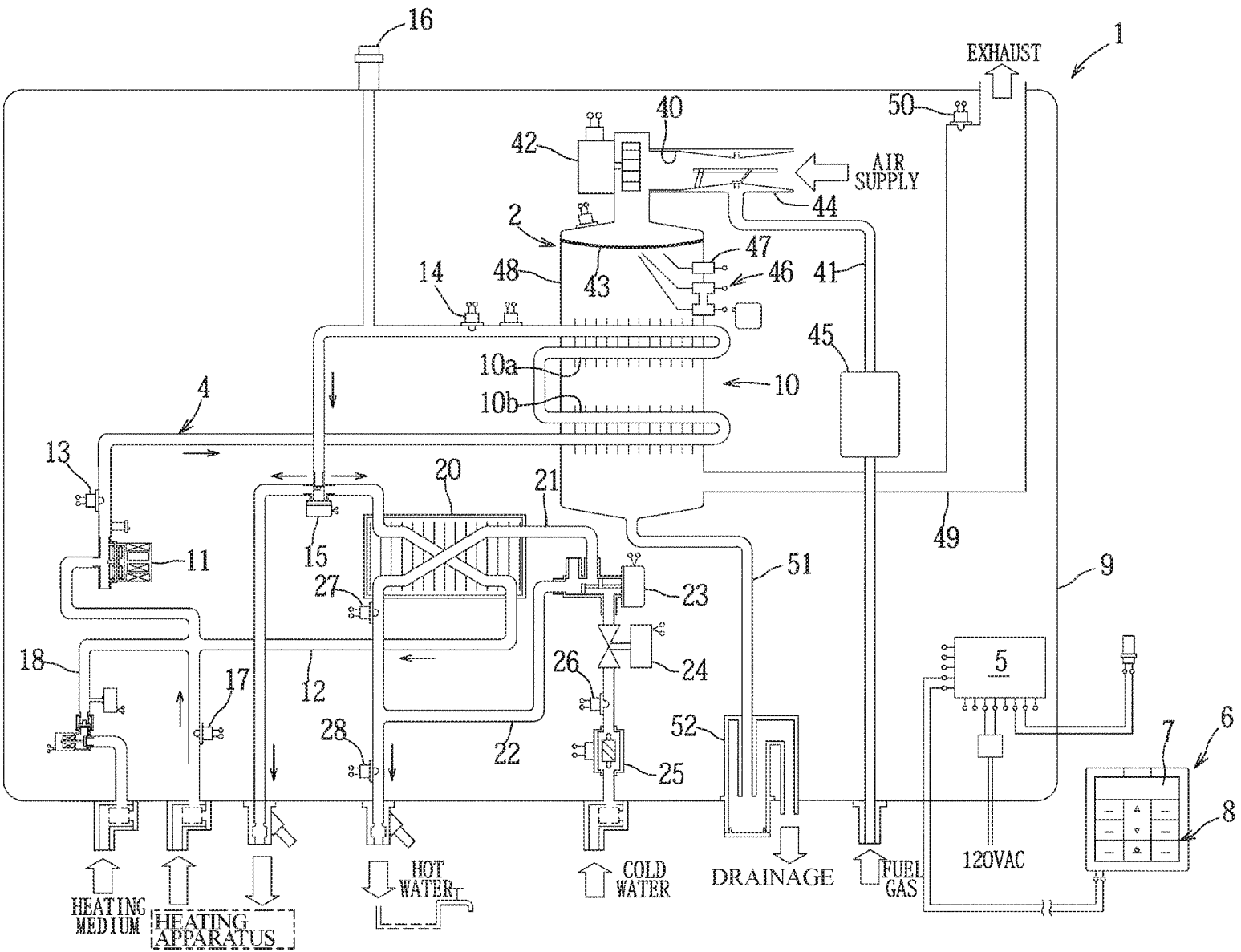
FIG. 1 is a figure schematically showing a heating and hot water supply device according to the present invention.

First, the overall constitution of the heating and hot water supply device 1 according to the present invention will be explained with reference to FIG. 1. The heating and hot water supply device 1 performs heating operation by circulating a heating thermal medium, to which heat has been applied by heat exchange with combustion gases generated by a combustion unit 2, to a heating apparatus not shown in the figures, and also performs hot water supply operation by supplying fresh water to which heat has been applied by heat exchange with the heating thermal medium, while adjusting its temperature to a set hot water supply temperature.

The heating and hot water supply device 1 comprises a combustion unit 2 which is a combustion means that mixes fuel gas and air together and combusts them, a main heat exchanger 10 that applies heat to the heating thermal medium by heat exchange with the combustion gases generated by the combustion unit 2, a circulation passage 4 that connects the main heat exchanger 10 with the heating apparatus, a circulation pump 11 that circulates the heating thermal medium through the circulation passage 4, and so on.

Moreover, the heating and hot water supply device 1 further comprises a first bypass passage 12 that branches off from the circulation passage 4 and bypasses the heating apparatus, a heat exchanger for hot water supply 20 that is provided in the first bypass passage 12, a hot water supply passage 21 for supplying cold water to the heat exchanger for hot water supply 20 and for supplying hot water to which heat has been applied by the heat exchanger for hot water supply 20, and so on. And a first distribution valve 15 (i.e. distribution means) is provided in the branching portion where the first bypass passage 12 branches off from the circulation passage 4.

Furthermore, the heating and hot water supply device 1 comprises a control unit 7 that receives detection signals from temperature sensors and etc. and controls heating operation and hot water supply operation by operating the circulation pump 11 and the first distribution valve 15, and also comprises a box shaped casing 8 that receives the devices described above. And, operating terminal of the heating and hot water supply device 1 is provided in a building to be heated by this device 1.

Next, the combustion unit 2 will be explained.

The combustion unit 2 comprises an intake passage 40 that takes in air for combustion, a fuel gas passage 41 that supplies fuel gas provided from the exterior into the intake passage 40, a combustion fan 24 that blows the resulting mixture of air and fuel gas through the intake passage 40, and a burner 43 that combusts the mixture gas that has been blown in by the combustion fan 42.

The flow rate of the air for combustion is controlled by the rotational speed of the combustion fan 42. Moreover, a venturi mixer 44 is provided at the downstream end of the fuel gas passage 41, and controls the flow rate of the fuel gas supplied by the rotational speed of the combustion fan 42. An electromagnetic valve 45 is provided in the fuel gas passage 41, and, by opening and closing the electromagnetic valve 45, the fuel gas supply is started or stopped.

The burner 43 starts combustion by igniting the mixture gas blown by the combustion fan 42 with an ignition device 46 that is provided below the burner 43. Moreover, a combustion sensor 47 is provided below the burner 43 and detects the state of combustion.

The main heat exchanger 10 is provided below the ignition device 46 and the combustion sensor 47. The main heat exchanger 10 and the burner 43 etc. are housed within a housing 48 that defines a passage for the combustion gases. The combustion gases generated by combustion of the mixture gas in the burner 43 are sent to the main heat exchanger 10, and, after having exchanged heat with the heating thermal medium, are exhausted to the exterior via an exhaust passage 49 that extends from the lower portion of the housing 48. An exhaust temperature sensor 50 is provided at the downstream end portion of the exhaust passage 49, and is capable of detecting the temperature of the exhausted combustion gases.

The main heat exchanger 10 comprises a primary heat exchanger 10*a* that recovers sensible heat from the combustion gases, and a secondary heat exchanger 10*b* that recovers latent heat from the combustion gases. These two heat exchangers 10*a*,10*b* are connected so that the heating thermal medium to which heat has first been applied by the secondary heat exchanger 10*b* then receives further application of heat from the primary heat exchanger 10*a*. A drainage passage 51 is provided at the bottom portion of the housing 48, and discharges drainage water that has been condensed in the secondary heat exchanger 10*b* to the exterior. In order to prevent the combustion gases from flowing out, a drainage trap 52 is provided at the downstream end portion of the drainage passage 51.

Next, the circulation passage 4 will be explained.

A first temperature sensor 13 which is capable of detecting the temperature of the heating thermal medium flowing into the main heat exchanger 10 is provided between the circulation pump 11 in the circulation passage 4 and the main heat exchanger 10. And a second temperature sensor 14 that is capable of detecting the temperature of the heating thermal medium to which heat has been applied by the main heat exchanger 10 is provided on the downstream side than the main heat exchanger 10.

A first distribution valve 15 is provided at the portion where the first bypass passage 12 branches off from the circulation passage 4, at the downstream side of the main heat exchanger 10. The first distribution valve 15 is capable of performing distribution while adjusting the distribution ratio of the heating thermal medium to which heat has been applied by the main heat exchanger 10 between the circulation passage 4 and the first bypass passage 12. The first bypass passage 12 rejoins the circulation passage 4 at the upstream side than the circulation pump 11.

A pressure relief valve 16 that relieves the pressure in the circulation passage 4 is provided between the main heat exchanger 10 and the first distribution valve 15. And a heating return temperature sensor 17 that is capable of detecting the temperature of the heating thermal medium returning from the heating apparatus is provided at the upstream side than the circulation pump 11. Moreover, a replenishment passage 18 for replenishing the heating thermal medium is connected between the circulation pump 11 and the heating return temperature sensor 17.

Next, the heat exchanger for hot water supply 20 will be explained.

The heat exchanger for hot water supply 20 provided in the first bypass passage 12 is a plate type heat exchanger. In such a plate type heat exchanger, a plurality of heat exchange plates are laminated together so that passages are defined between the heat exchange plates. Within the heat exchanger for hot water supply 20, the heating thermal medium and the water for hot water supply flow through alternate passages defined between the heat exchange plates, arranged so that these flows oppose one another and do not mix with one another. The surface area of each of the heat exchange plates is formed with irregular roughnesses, in order to enhance the heat exchange efficiency.

Next, the hot water supply passage 21 will be explained.

The hot water supply passage 21 is capable of supplying fresh water to the heat exchanger for hot water supply 20, and also is capable of supplying hot water to which heat has been applied by the heat exchanger for hot water supply 20 to a hot water supply faucet or the like, and moreover a second bypass passage 22 is provided that branches off from the hot water supply passage 21 and bypasses the heat exchanger for hot water supply 20. A second distribution valve 23, which is equivalent to a flow rate adjustment means, is provided at the branching portion between the hot water supply passage 21 and the second bypass passage 22. The second distribution valve 23 is capable of fresh water distribution by adjusting the distribution ratio between the hot water supply passage 21 and the second bypass passage 22. Due to this, the second distribution valve 23 is capable of regulating the flow rate of fresh water flowing into the hot water supply passage 21.

A flow rate regulation valve 24, a hot water supply amount sensor 25, and an intake water temperature sensor 26 are provided at the upstream side than the second distribution valve 23. The flow rate regulation valve 24 is capable of regulating the flow rate of the fresh water that passes into the second distribution valve 23. The hot water supply amount sensor 25 is capable of detecting the flow rate of the fresh water that has been thus regulated. And the intake water temperature sensor 26 is capable of detecting the temperature of the fresh intake water that passes into the second distribution valve 23.

An output hot water temperature sensor 27 is provided between the location where the hot water supply passage 21 and the second bypass passage 22 join together and the heat exchanger for hot water supply 20. The output hot water temperature sensor 27 is capable of detecting the temperature of the hot water outputted from the heat exchanger for hot water supply 20. And a hot water supply temperature sensor 28 is provided downstream of the location where the hot water supply passage 21 and the second bypass passage 22 join together. The hot water supply temperature sensor 28 is capable of detecting the temperature of the mixture water that results from the mixing together of the hot water to which heat has been applied by the heat exchanger for hot water supply 20 and the fresh water flowing through the second bypass passage 22.

Next, the control unit 5 and the operating terminal 6 will be explained. Although this feature is not shown in the figure, the control unit 5 is capable of receiving detection signals from the various temperature sensors etc. provided within the heating and hot water supply device 1, and moreover is connected to the circulation pump 11 and the first distribution valve 15 etc. so as to be capable of controlling them. Moreover, an operating terminal 6 that is provided within the building to which this heating and hot water supply device 1 is fitted is connected to the control unit 5, so as to be capable of communicating therewith. The operating terminal 6 may, for example, comprise a display means 7 that is capable of displaying, for example, temperature and operating status and so on, and to an operation unit 8 for performing setting of the heating temperature and the hot water supply temperature, and for performing starting operation and stopping operation for space heating operation and so on.

The display means 7 of the operating terminal 6 comprises a display unit for displaying the time, several 7 segment display units, a display unit for unit of temperature, and an operating display unit that displays various items related to operating status. These display units are of a type in which a light source such as a plurality of LEDs etc. provided at the rear of the display unit is illuminated, and light is emitted forward and passes through transparent portions that are formed in predetermined display patterns, so that an illuminated display is provided.

Figure 2:
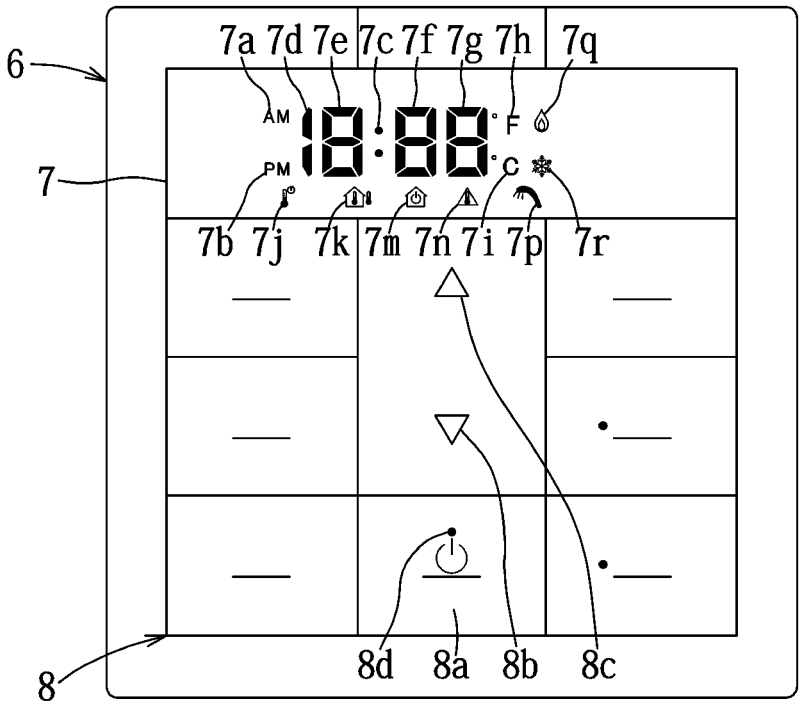
FIG. 2 is an elevation view of an operating terminal.

As shown in FIG. 2, the display unit for displaying the time comprises an AM display 7*a* that displays "AM", a PM display 7*b* that displays "PM", and a colon display 7*c* that is separated into hours and minutes. The 7 segment display units include two 7 segment display units 7*d*, 7*e* that are disposed at the left side of the colon display 7*c*, and two 7 segment display units 7*f*, 7*g* that are disposed at the right side of the colon display 7*c*. The 7 segment display unit 7*d* at the left end is provided with only two segments for displaying the digit "1", but alternatively may also be capable of displaying the digits "0" through "9" and alphabetic characters, in a similar manner to the other 7 segment display units 7*e* through 7*g*.

The display unit for temperature comprises a Fahrenheit display 7*h* and a Celsius display 7*i*. The operating display unit comprises a residual heat display 7*j* that indicates residual heat operation, an external air display 7*k* that indicates connection of an external air temperature sensor, a heating display 7*m* that indicates heating operation, a high temperature display 7*n* that indicates hot water supply operation at an excessively high temperature, a hot water supply display 7*p* that indicates hot water supply operation, a combustion display 7*q* that indicates combustion by the burner 43, and a freezing prevention display 7*r* that indicates freezing prevention operation.

The heating display 7*m* is illuminated while the first distribution valve 15 is causing the heating thermal medium to be circulated so as to be distributed to the side of the circulation passage 4. The hot water supply display 7*p* is illuminated while the hot water supply flow rate sensor 25 provided in the hot water supply passage 21 is detecting a flow rate greater than or equal to a predetermined flow rate. The combustion display 7*q* is illuminated while the combustion sensor 47 is detecting a flame. And the freezing prevention display 7*r* is illuminated while the circulation pump 11 is operating when heating operation is not being performed.

A plurality of buttons are provided to the operation unit 8, such as an operating button 8*a*, selection buttons 8*b*, 8*c* for selecting items or numerical values etc. Among these, light emission units 8*d* that make it possible for the "on" state to be checked visually are provided to one or more buttons that go into the "on" state when pressed once, for example to the operating button 8*a*. This light emission unit 8*d* is illuminated by light source including LEDs provided behind the button being transmitted through it.

Figure 3:
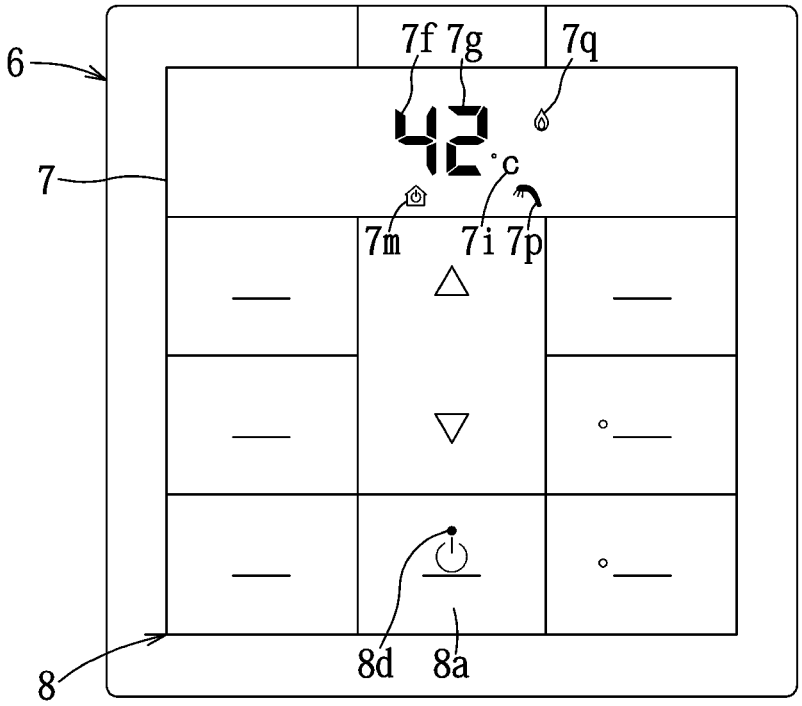
FIG. 3 is a figure showing an example of a display during simultaneous heating operation and hot water supply operation.

Next, the operation and the advantageous effects according to the heating and hot water supply device 1 will be explained with reference to FIGS. 1 through 3.

If, during waiting for operation of the heating and hot water supply device 1, the user opens a hot water faucet or the like so that the hot water supply flow rate sensor 25 detects a flow rate greater than or equal to the predetermined flow rate, then hot water supply operation is started. The control unit 5 adjusts the first distribution valve 15 so that the heating thermal medium circulates only in the first bypass passage 12, and, along with operating the circulation pump 11 so that the heating thermal medium is circulated in the first bypass passage 12, also operates the combustion fan 42 and the ignition device 46, thus starting combustion of mixture gas by the burner 43.

The combustion gases that are generated apply heat to the heating thermal medium in the main heat exchanger 10. And, due to this heating thermal medium, water is heated up by the heat exchanger for hot water supply 20. The control unit 5 adjusts the distribution ratio of the second distribution valve 23 on the basis of the output temperature of the water to which heat has been applied by the heat exchanger for hot water supply 20 and the set hot water supply temperature, and thereby the water to which heat has been applied by the heat exchanger for hot water supply 20 and the fresh water in the second bypass passage 22 are mixed together, and hot water is supplied at the set hot water supply temperature.

At this time, when hot water supply operation is started, the hot water supply display 7*p* on the display means 7 of the operating terminal 6 is illuminated. Moreover, when the combustion sensor 47 provided to the combustion unit 2 detects a flame, the combustion display 7*q* is illuminated. The set hot water supply temperature is displayed by illuminating the 7 segment display units 7*e* through 7*g*, and one of the Fahrenheit display 7*h* or the Celsius display 7*i* is illuminated, thus indicating the unit of temperature. With these displays, the user is enabled to check the operating status of the heating and hot water supply device 1 simply and easily. It may be possible to arrange to display the set heating temperature while changing over between Fahrenheit and Celsius by actuation of the selection buttons 8*b*, 8*c* of the operation unit 8. Furthermore, it may be possible to arrange for it to possible to display the time or the set hot water supply temperature or the like on the 7 segment display units 7*d* through 7*g*, while changing it by operation of the selection buttons 8*b*, 8*c*.

On the other hand if, during waiting for operation of the heating and hot water supply device 1, heating operation is started by a request signal for heating operation from the heating apparatus, then the control unit 5 adjusts the first distribution valve 15 so that the heating thermal medium circulates only in the circulation passage 4, and, along with operating the circulation pump 11 so that the heating thermal medium is circulated in the circulation passage 4, also operates the combustion fan 42 and the ignition device 46, thus starting combustion of mixture gas by the burner 43. The combustion gases that are generated apply heat to the heating thermal medium in the main heat exchanger 10. And, as the heating operation continues, the heating thermal medium continues to circulate at a predetermined temperature.

At this time, due to the distribution of the heating thermal medium to the circulation passage 4 by the distribution valve 15, the heating display 7*m* is illuminated. When the combustion sensor 47 provided to the combustion unit 2 detects a flame, the combustion display 7*q* is illuminated. The set heating temperature is displayed by illuminating the 7 segment display units 7*f*, 7*g*, and one of the Fahrenheit display 7*h* or the Celsius display 7*i* is illuminated, thus indicating the units of temperature. With these displays, the user is enabled to check the operating status of the heating and hot water supply device 1 simply and easily. It would also be acceptable to arrange for the display to be changed over by operation of the selection buttons 8*b*, 8*c*, as in the case of hot water supply operation.

If, during heating operation, due to a hot water supply faucet being opened, the hot water supply flow rate sensor 25 detects a flow rate greater than or equal to a predetermined flow rate, then simultaneous heating operation and hot water supply operation is started. In a similar manner to the case with hot water supply operation described above, the control unit 5 adjusts the first distribution valve 15 so that the heating thermal medium circulates only in the first bypass passage 12, and, due to the heating thermal medium, heat is applied to water by the heat exchanger for hot water supply 20. Moreover, the control unit 5 adjusts the distribution ratio of the second distribution valve 23 so that hot water is supplied at the set hot water supply temperature. At this time, the heating display 7*m* is extinguished and the hot water supply display 7*p* is illuminated, and the set hot water temperature is displayed by appropriately illuminating the 7 segment display units 7*e* through 7*g*.

If the control unit 5 determines, on the basis of the set hot water supply temperature and the output hot water temperature and so on, that it would be possible to supply hot water at the set hot water supply temperature even with some of the heating thermal medium being supplied to the space heating terminal, then the control unit adjusts the distribution ratio of the first distribution valve 15 so that the heating thermal medium is also distributed toward the heating apparatus, and thereby simultaneous heating operation and also hot water supply operation are performed.

Since, at this time, the fact that simultaneous heating operation and hot water supply operation are being performed is displayed by both the heating display 7*m* being illuminated and also the hot water supply display 7*p* being illuminated, accordingly the user is enabled simply and easily visually to check the operating status of the heating and hot water supply device 1. It would also be acceptable to make the heating display 7*m* and the hot water supply display 7*p* flash simultaneously or alternately, in order for the user easily to confirm that simultaneous heating operation and hot water supply operation are both being performed. Alternatively, it would also be possible to arrange for the set hot water supply temperature and the set heating temperature to be displayed alternately by the 7 segment display units 7*e* through 7*g*.

On the other hand, if the operational output at the present time is insufficient for the required operating capability, then, if for example during simultaneous heating operation and hot water supply operation the output for heating operation becomes insufficient because the supply amount of hot water has increased, the heating display 7*m* is illuminated in a different display mode from its normal display mode when there is no shortage of operational output. This display mode that is different from the normal display mode may mean that illumination is performed in a different color from normal, or may mean that the brightness of illumination is different from normal. For example, as opposed to normal operation in which the heating display 7*m* is illuminated in orange color, in the different display mode it may be illuminated in red color, or the heating display 7*m* may be illuminated more brightly than normal. It would also be acceptable to vary the color and/or the brightness continually. Since the display is provided in a display mode that is different from the normal display mode, accordingly the user is enabled visually to check the operating status of the heating and hot water supply device 1 simply and easily.

As explained above, the heating and hot water device 1 according to the present invention is capable of performing heating operation, or hot water supply operation, or simultaneous heating operation and hot water supply operation; and since, by employing the heating display 7*m* and the hot water supply display 7*p*, it is possible to perform any of heating operation, or hot water supply operation, or simultaneous heating and hot water supply operation, and to display the three types of operating status, i.e. heating operation, or hot water supply operation, or simultaneous heating operation and hot water supply operation, accordingly the user is enabled visually to check the operating status of the heating and hot water supply device simply and easily.

The display of the display means 7 may not only be provided on the dedicated operating terminal 6 of the heating and hot water supply device 1; it could also be provided on a general purpose terminal such as a smart phone, a tablet terminal, or the like. In such a case, it may be arranged to load a program for providing this display into the general purpose terminal and for that program to be capable of communication with the control unit 5 via a wireless LAN or the like, so that the operating status etc. of the heating and hot water supply device 1 is displayed on the general purpose terminal. Within the range in which communication with the control unit 5 is possible, the user is able simply and easily to check the operating status of the heating and hot water supply device 1 by displaying that status on the general purpose terminal.

Apart from the above, for a person skilled in the art, it would be possible to implement the present invention by adding various changes to the embodiments described above without deviating from the gist of the invention, and the present invention is to be understood as including such variant embodiments.

DESCRIPTION OF REFERENCE NUMERALS

1: heating and hot water supply device
2: combustion unit (combustion means)
4: circulation passage
5: control unit
6: operating terminal
7: display means
7*m*: heating display
7*p*: hot water supply display
10: main heat exchanger
11: circulation pump
12: first bypass passage (bypass passage)
15: first distribution valve (distribution means)
20: heat exchanger for hot water supply
21: hot water supply passage

The invention claimed is:

1. A heating and hot water supply device, comprising a combustion means, a main heat exchanger, a circulation passage connected to the main heat exchanger and a heating apparatus, a circulation pump provided in the circulation passage, a bypass passage that branches off from the circulation passage and bypasses the heating apparatus, a heat exchanger for hot water supply provided in the bypass passage, a hot water supply passage for supplying cold water to the heat exchanger for hot water supply and for supplying hot water heated to a predetermined set hot water supply temperature by the heat exchanger for hot water supply, a control unit that controls a plurality of devices, and an operating terminal connected to the control unit so as to be capable of communication therewith for performing a plurality of operations including a heating operation, a hot water supply operation, and a simultaneous heating operation and hot water supply operation, wherein:

a distribution means is provided at a branching portion of the bypass passage, and the distribution means is capable of adjusting a distribution ratio so that the heating operation, or the hot water supply operation, or the simultaneous heating operation and hot water supply operation become possible; and a display means is provided to the operating terminal, and is capable of providing displays corresponding to each of the plurality of operations, wherein the control unit is configured to display in the display means at least one of a heating display corresponding to the heating operation and a hot water supply display corresponding to the hot water supply operation in a display mode in a different color or in a different brightness of illumination from when there is no such shortage of operational output, as a present operational output is insufficient with respect to a required operating capability for a corresponding operation.

2. The heating and hot water supply device according to claim 1, wherein the display means is adapted to provide at least a heating display corresponding to the heating operation and a hot water supply display corresponding to the hot water supply operation, and, during simultaneous heating operation and hot water supply operation, the heating display and the hot water supply display are illuminated, or are flashed simultaneously, or are flashed alternately.

* * * * *